US006166715A

United States Patent [19]

Chang et al.

[11] Patent Number: 6,166,715

[45] Date of Patent: Dec. 26, 2000

[54] THIN-FILM TRANSISTOR LIQUID-CRYSTAL DISPLAY DRIVER

[75] Inventors: Chia-Yuan Chang, Ping-Tung Hsien; Nang-Ping Tu, Hsinchu, both of Taiwan

[73] Assignee: Industrial Technology Research Institute, Taiwan

[21] Appl. No.: 08/805,315

[22] Filed: Feb. 25, 1997

[30] Foreign Application Priority Data

Sep. 10, 1996 [TW] Taiwan ..... 86202994

[51] Int. Cl.[7] ..... G09G 3/36

[52] U.S. Cl. ..... 345/100; 345/98; 345/99

[58] Field of Search ..... 345/92, 112, 118, 345/155, 24, 214, 80, 90, 98–100, 103, 204, 211–212

[56] References Cited

U.S. PATENT DOCUMENTS

| | | | |
|---|---|---|---|
| 4,931,787 | 6/1990 | Shannon | 345/93 |
| 4,975,691 | 12/1990 | Lee | 345/79 |
| 5,103,218 | 4/1992 | Takeda | 345/100 |
| 5,166,671 | 11/1992 | Maekawa | 345/100 |
| 5,196,738 | 3/1993 | Takahara et al. | 327/530 |
| 5,335,023 | 8/1994 | Edwards | 348/800 |
| 5,453,991 | 9/1995 | Suzuki et al. | 714/724 |
| 5,616,936 | 4/1997 | Misawa et al. | 345/80 |
| 5,654,735 | 8/1997 | Nakajima | 345/99 |
| 5,682,175 | 10/1997 | Kitamura | 345/98 |
| 5,719,591 | 2/1998 | Callahan, Jr. et al. | 345/98 |
| 5,751,279 | 5/1998 | Okumura | 345/212 |
| 5,771,031 | 6/1998 | Kinoshita et al. | 345/98 |
| 5,856,818 | 1/1999 | Oh et al. | 345/99 |
| 5,973,661 | 10/1999 | Kobayashi et al. | 345/100 |

*Primary Examiner*—Richard A. Hjerpe
*Assistant Examiner*—Henry N. Tran
*Attorney, Agent, or Firm*—Birch, Stewart, Kolasch & Birch, LLP

[57] ABSTRACT

A thin-film transistor liquid-crystal display (TFT LCD) driver includes a shift register, a sample and hold circuit, a group block, and a controller. The shift register provides N graded sample clocks. Video signals are delivered to the group block via the sample and hold circuit through the control of the controller. The group block having n groups of N switches transfers a group of N pixel signals from the sample and hold circuit to the display. The display driver of the invention providing n×N output lines by using N processing units by virtue of the output distribution of the group block not only reduces circuit space, but also lowers the power consumption requirements.

12 Claims, 8 Drawing Sheets

THIN-FILM TRANSISTOR LIQUID-CRYSTAL DISPLAY DRIVER

BACKGROUND OF THE INVENTION

1. Field of the Invention

The invention relates to a thin-film transistor liquid-crystal display (TFT LCD) driver. More particularly, the invention relates to a thin-film transistor liquid-crystal display driver with smaller layout area and lower power consumption than the conventional display driver.

2. Description of Related Art

At present, thin-film transistor liquid-crystal displays are superior to other types of displays at least in regards to overall size and portability. Because thin-film transistor liquid-crystal displays are constructed with an array having a multitude of display units, a complicated display driver circuit is required for delivering the signals to each of the display units. Improvements to the conventional thin-film transistor liquid-crystal displays can be made by miniaturizing the complicated display driver circuit.

Referring to FIG. 1, a display driver circuit of a conventional thin-film transistor liquid-crystal display is shown. The conventional display driver circuit includes a controller 100, a shift register 120 and a sample and hold circuit 140. The shift register 120 and the sample and hold circuit 140 are controlled by the controller 100 and deliver video signal to a display panel 200.

To illustrate the complexity of the conventional display driver circuit, the specifications of a standard VGA display panel (640×480) are used. A VGA display panel needs 640 driving paths. Under this condition, the shift register 120 and the sample and hold circuit 140 must include 640 processing units to individually deliver the 640 output pixel signals to the display panel 200.

As shown in FIG. 1, the output of the sample and hold circuit 140 is delivered to the display panel 200 via operational amplifiers 151, 152, 153, etc. According to the illustration of a VGA display panel described above, the sample and hold circuit 140 has a total of 640 outputs each of which is amplified by a separate operational amplifier 151, 152, 153, etc. Therefore, the conventional VGA display driver requires a total of 640 operational amplifiers.

Because operational amplifiers take up a large amount of circuit space and consume a great deal of power, the conventional display driver is seriously affected by high power consumption and large circuit area. Because TFT LCD displays are used in portable, battery powered computers, the high power consumption of the conventional display driver has serious disadvantages in regards to battery life. Furthermore, this high power consumption does not meet the low power design requirements of a so called environmentally friendly "green computer".

Moreover, the shift register 120 and sample and hold circuit 140 requiring 640 processing units each with a large circuit structure are not in accord with the spirit of circuit miniaturization.

These problems are exacerbated when the array of the display panel 200 has a greater resolution than VGA because the required circuit layout area of the display driver circuit greatly expands and the power demands are further increased.

SUMMARY OF THE INVENTION

Therefore, an object of the invention is to provide a thin-film transistor liquid-crystal display driver which reduces the circuit layout area by reducing the size of the shift register, the size of the sample and hold circuit, and the number of operational amplifiers.

Another object of the invention is to provide thin film transistor liquid crystal display with reduced power consumption.

The objects of the invention are achieved with the thin-film transistor liquid-crystal display driver of the invention for driving an nNxM display which includes an N graded shift register, a sample and hold unit having N processing units, a group block, and a controller.

The controller controls the shift register to provide N graded sample clocks to successively clock video signals into the N processing units of the sample and hold circuit. In this way, N pixel signals are created for the group block. The group block, including n groups of N switches, receives N pixel signals from the sample and hold circuit each cycle and then provides the N pixel signals to the display panel for each of the n groups in order.

In the illustrated example of a VGA thin-film transistor liquid-crystal display driver in which N is 40 and n is 16, the shift register provides 40 graded sample clocks, the sample and hold circuit includes 40 processing units, and the group block includes 16 groups of 40 switches. Although there are 640 lines between the group block and display panel the structures of the shift register and the sample and hold circuit are simplified and only 40 operational amplifiers are used. Therefore, reduced circuit layout area and lower power consumption are achieved by the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
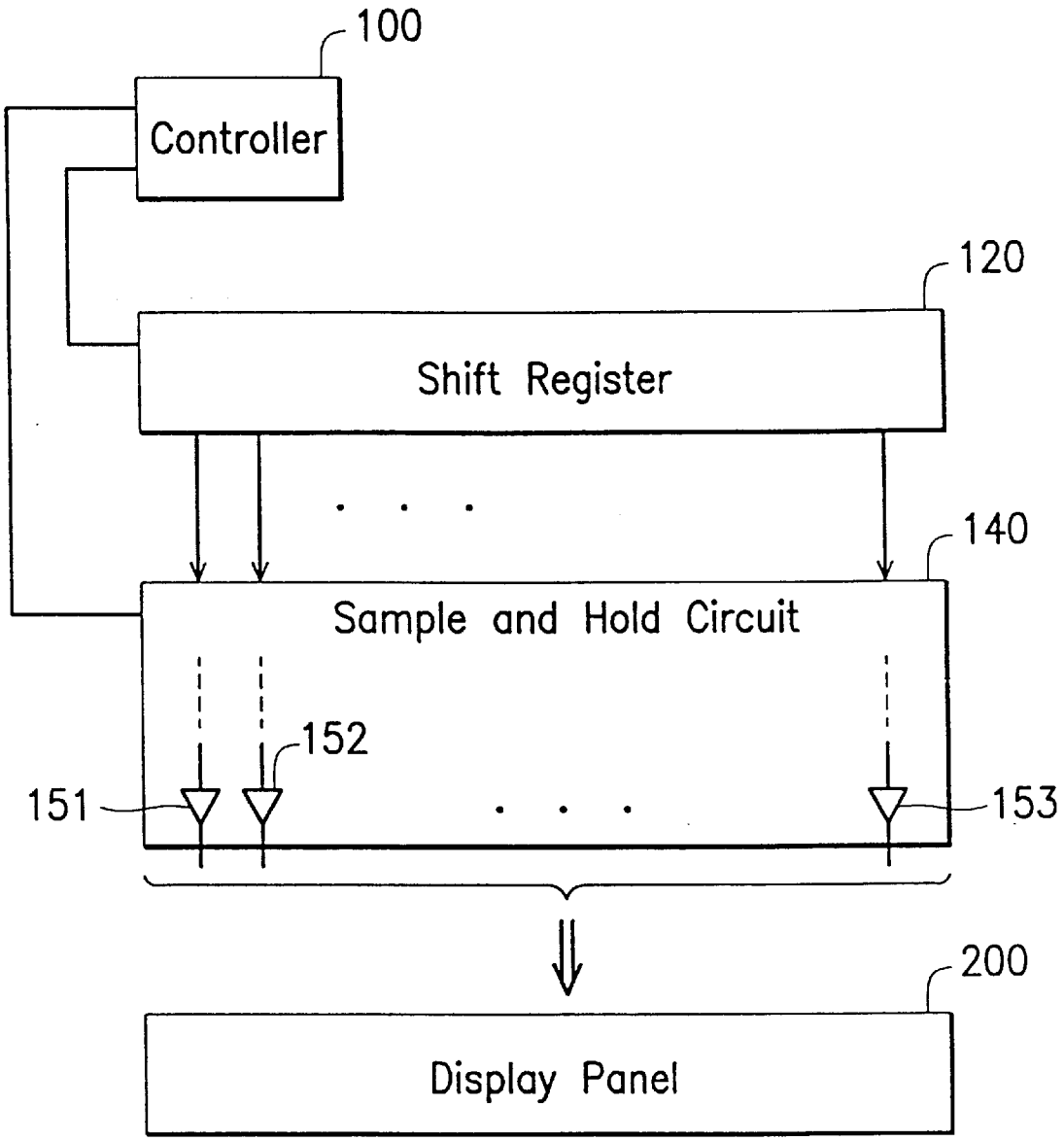
FIG. 1 (PRIOR ART)
FIG. 1 is a schematic view showing a circuit structure of a conventional display driver.
Figure 2:
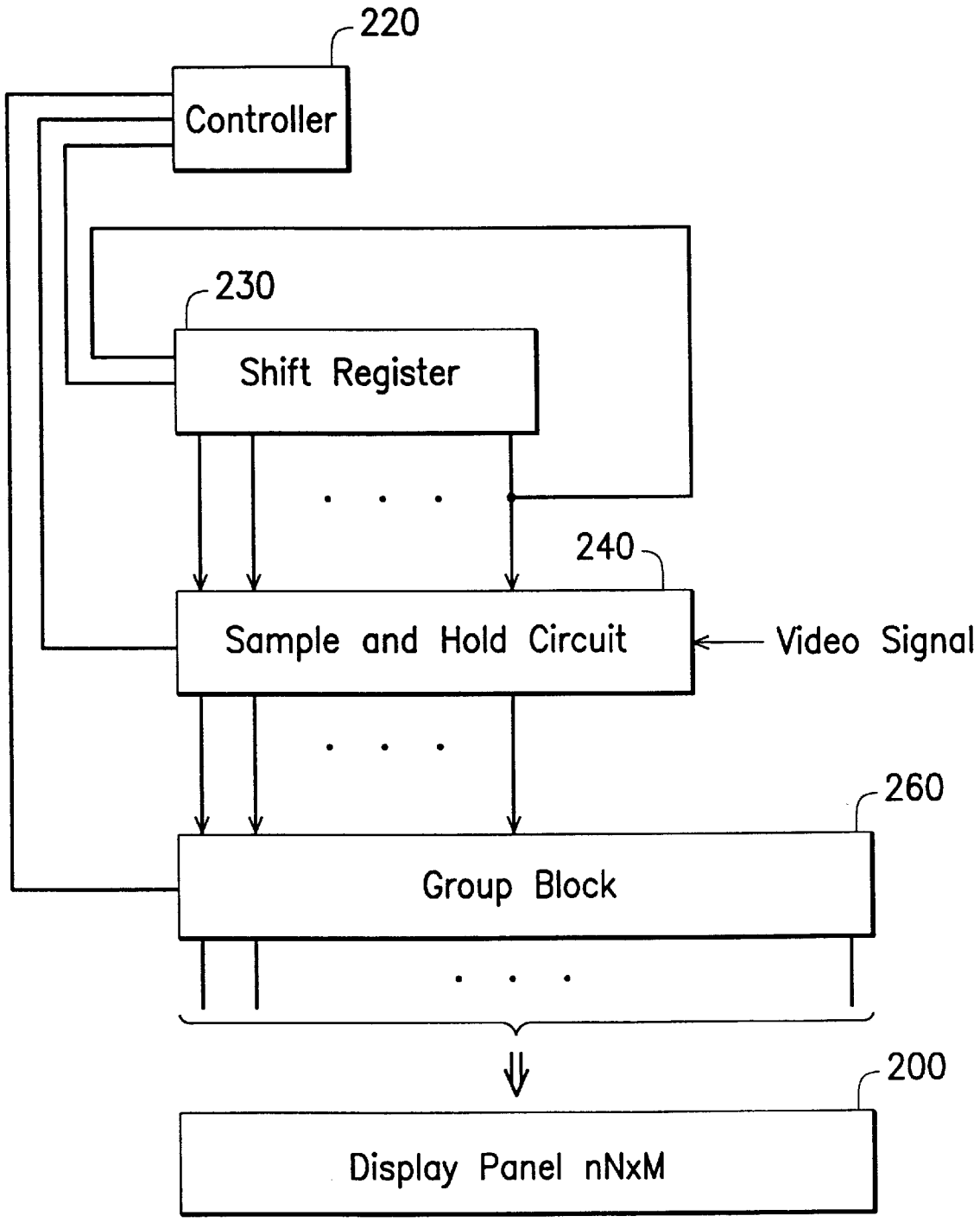
FIG. 2 is a schematic view showing a circuit structure of an embodiment of the invention.

Referring to FIG. 2, a circuit structure of an embodiment of the invention is shown. The thin-film transistor liquid-crystal display driver for driving an nNxM or MxnN display includes a controller 220, a shift register 230, a sample and hold circuit 240 and a group block 260 which are connected as follows: the shift register 230 is connected to the sample and hold circuit 240 which is connected to the group block 260 which, in turn, is connected to the display panel 200. Furthermore, the sample and hold circuit 240 has a video signal input. In addition, the controller is connected to the shift register 230, sample and hold circuit 240 and the group block 260.

The sample and hold circuit 240 includes N parallel processing units as will be described in relation to FIG. 3 below. "Sample" is the capacitor charging process and "hold" is the output process, so the circuit 240 is termed a sample and hold circuit.

Furthermore, the group block 260 includes n groups of N switches as will be described in relation to FIG. 4 below.

The operation of the display driver for driving the nNxM display panel 200 shown in the FIG. 2 is as follows. The shift register 230 outputs N graded sample clocks to the sample and hold circuit 240 under the control of the controller 220. Each time the shift register 230 outputs a sample clock to the sample and hold circuit 240, video signal are delivered to the N processing units, such as processing unit $\mathbf{245}_1$, of the sample and hold circuit 240 as will be described in relation to FIG. 3 below.

When a group of N pixel signals have accumulated in the sample and hold circuit 240, the N pixel signals are delivered to one of the n groups in the group block 260 under the control of the controller 220. The group block 260 includes n groups in order to re-direct n groups of signals from the sample and hold circuit 240.

Based on the above, the shift register 230 and the sample and hold circuit 240 of the invention only include a total of N processing units which deliver n groups of N pixel signals to the display panel 200 via data re-direction in the group block 260. Hence, the invention outputs display driving signals compatible with conventional display panels while reducing the circuit space required for the display driver.

To illustrate the invention, an example of the invention wherein N=40 and n=16 will be explained below.

In the example, the display driver provides 640 output lines from the display driver circuit to display panel 200. Unlike the conventional display driver, however, the shift register 230 and the sample and hold circuit 240 need not have 640 processing units each because the group block 260 has 16 groups of 40 switches which re-direct the pixel signal to the display panel 200.

According to above, the shift register 230 and the sample and hold circuit 240 only need 40 processing units each. More particularly, the shift register 230 outputs 40 graded sample clocks and the sample and hold circuit 240 includes only 40 parallel-processing units ($\mathbf{245}_1$ to $\mathbf{245}_{40}$). The sampling and holding of the 40 pixel signals, controlled by the shift register 230, pass through the sample and hold circuit 240 and are re-directed by the group block 260 to one of the 16 groups in order. With 16 such re-directions, the pixel signals flow through the whole group block 260 to provide 640 outputs to the display panel 200.

Figure 3:
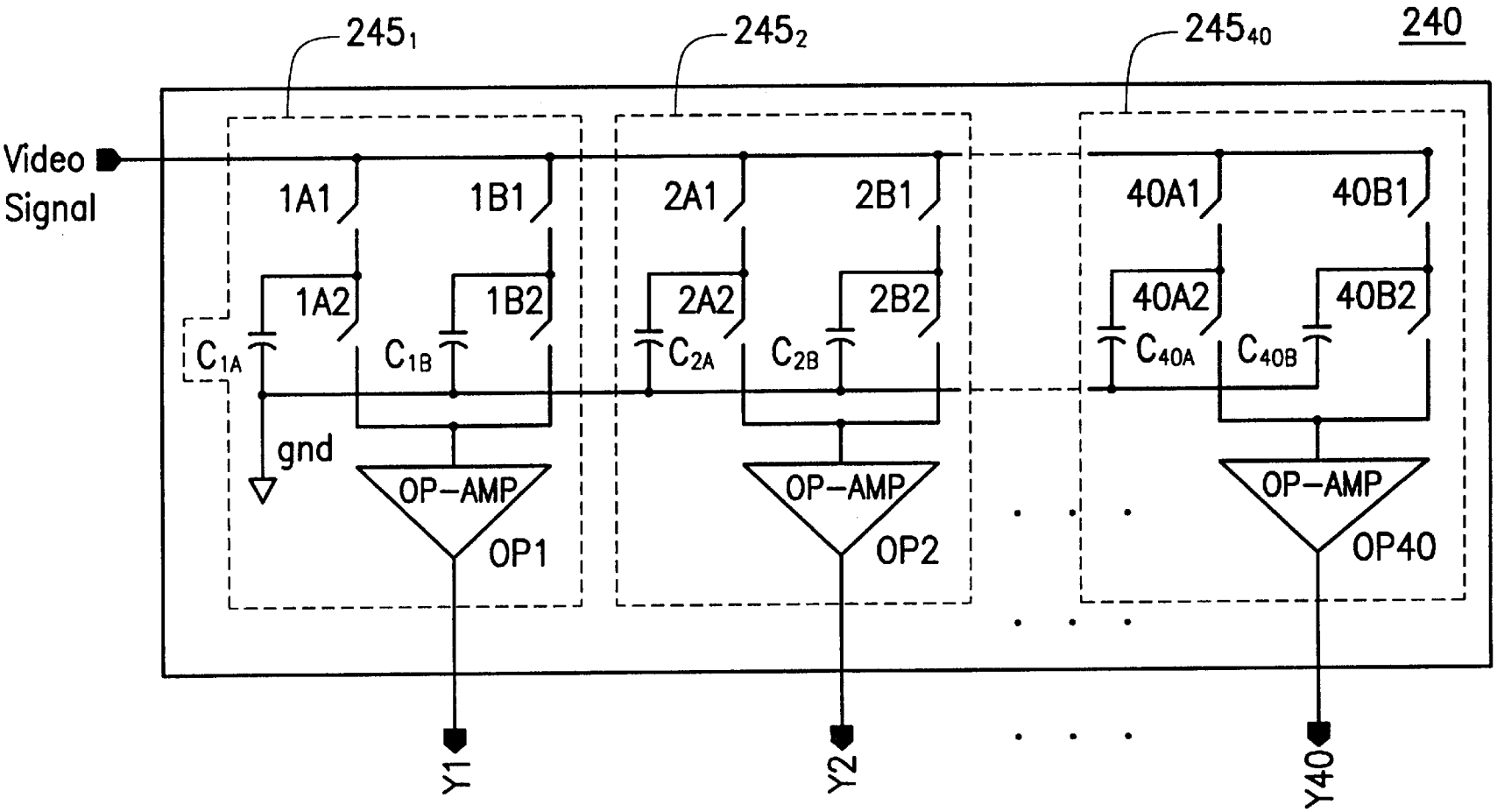
FIG. 3 is a schematic view showing a circuit structure of the sample and hold circuit shown in FIG. 2.

Referring to FIG. 3, there is depicted an exemplary sample and hold circuit 240 according to the illustrative example mentioned above. The entire sample and hold circuit 240 has a total of 40 processing units $\mathbf{245}_1$ to $\mathbf{245}_{40}$. Each processing unit 245 includes two pairs of switches, a pair of capacitors, and one operational amplifier.

Using the processing unit $\mathbf{245}_1$ as an example, the first processing unit $\mathbf{245}_1$ includes two pairs of switches (1A1, 1A2) and (1B1, 1B2), a pair of capacitors $C_{1A}$, $C_{1B}$, and an operational amplifier OP1. Each switch mentioned above is controlled by the shift register 230.

Figure 6:
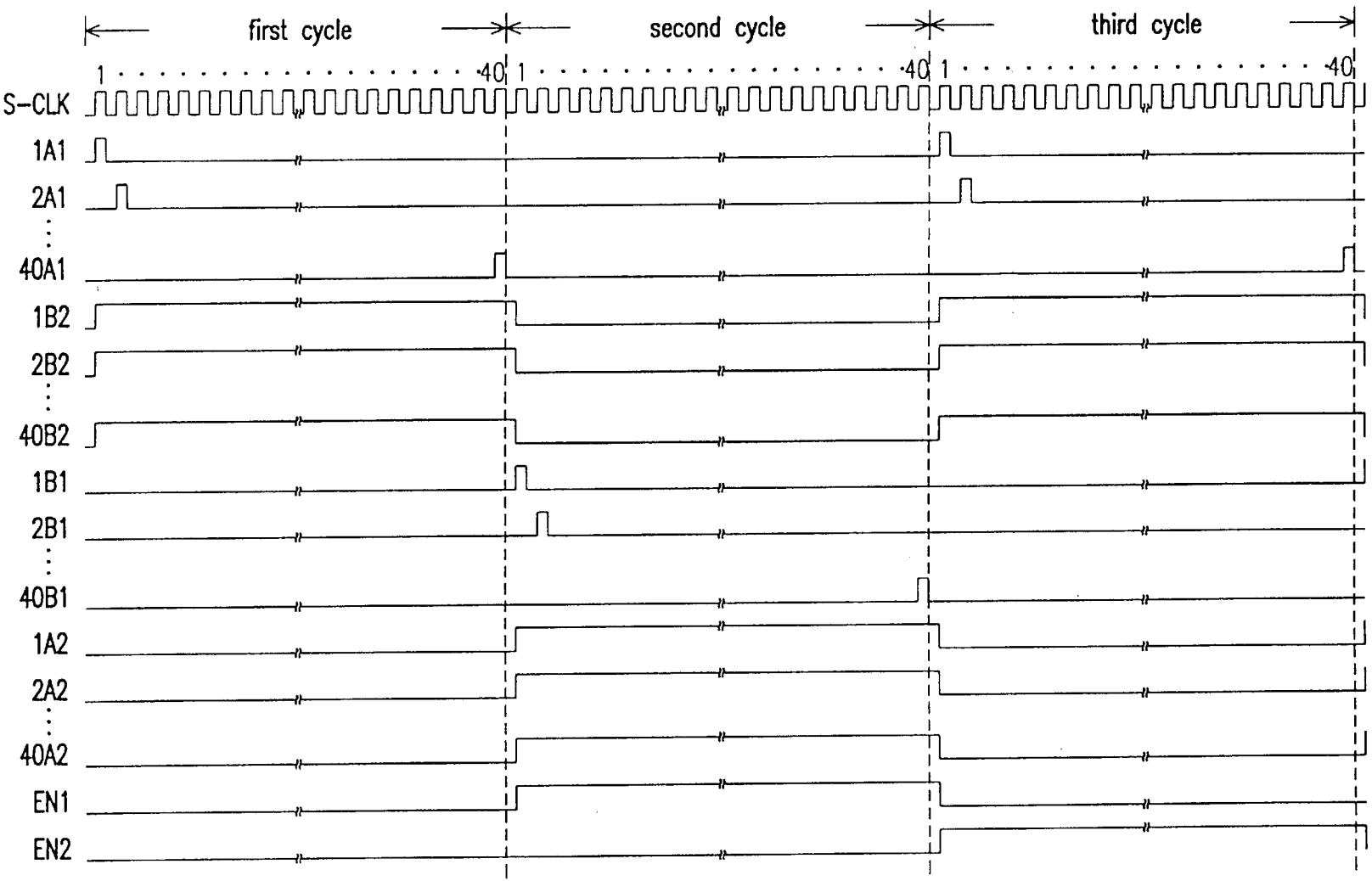
FIG. 6 is a timing diagram showing relative clocks of the signals between the sample and hold circuit and the group block.

FIG. 6 is a timing diagram for explaining the timing of opening and closing the various switches in the exemplary sample and hold circuit 240 shown in FIG. 3.

During the first cycle, as shown in FIG. 6, switches 1A2 and 1B1 remain open and switch 1B2 remains closed. Also during the first cycle, switch 1A1 receives a pulse from shift register 230 momentarily closing switch 1A1 so as to sample a pixel value from the video input. The result is that capacitor $C_{1A}$ accumulates an electrical charge representing a corresponding pixel value and the accumulated charge on capacitor $C_{1B}$ is outputted through the operational amplifier OP1.

Also during the first cycle, as further shown in FIG. 6, switches 2A2 and 2B1 remain open and switch 2B2 remains closed. Still further during the first cycle, switch 2A1 receives a pulse (time shifted by one pulse period from the pulse supplied to switch 1A1) from shift register 230 momentarily closing switch 2A1 so as to sample a next pixel value from the video input. The result is that capacitor $C_{2A}$ accumulates an electrical charge representing a corresponding pixel value and the accumulated charge on capacitor $C_{2B}$ is outputted through the operational amplifier OP2.

During the second cycle, as further shown in FIG. 6, switches 1B2 and 1A1 remain open and switch 1A2 remains closed. Also during the second cycle, switch 1B1 receives a pulse from shift register 230 momentarily closing switch 1B1 so as to sample a pixel value from the video input. The result is that capacitor $C_{1B}$ accumulates an electrical charge representing a corresponding pixel value and the accumulated charge on capacitor $C_{1A}$ is outputted through the operational amplifier OP1.

Also during the second cycle, as still further shown in FIG. 6, switches 2B2 and 2A1 remain open and switch 2A2 remains closed. Also during the second cycle, switch 2B1 receives a pulse from shift register 230 momentarily closing switch 2B1 so as to sample a pixel value from the video input. The result is that capacitor $C_{2B}$ accumulates an electrical charge representing a corresponding pixel value and the accumulated charge on capacitor $C_{2A}$ is outputted through the operational amplifier OP2.

The operation of processing units $\mathbf{245}_3$ to $\mathbf{245}_{40}$ is similar to the operation of processing unit $\mathbf{245}_1$ and $\mathbf{245}_2$ described above. In fact, the switch closure operations described above may be generalized to N processing units. For example, during the first cycle, switches NA2 and NB1 remain open and switch NB2 remains closed. Also during the first cycle, switch NA1 receives a pulse from shift register 230 momentarily closing switch NA1 so as to sample a pixel value from the video input. The result is that capacitor $C_{NA}$ accumulates an electrical charge representing a corresponding pixel value and the accumulated charge on capacitor $C_{NB}$ is outputted through the operational amplifier OPN.

As mentioned above, shift register 230 continues to output a sequence of time-shifted pulses during the first cycle to momentarily close switches 1A1 to 40A1 in sequence. Thus, switches 1A1 to 40A1 sample sequential pixel values from the video input. In general terms, switches 1A1 to NA1 sample sequential pixel values from the video input during the first cycle.

As further shown in FIG. 6, shift register 230 continues to output a sequence of time-shifted pulses during the second cycle to momentarily close switches 1B1 to 40B1 in sequence. Thus, switches 1B1 to 40B1 sample sequential pixel values from the video input. In general terms, switches 1B1 to NB1 sample sequential pixel values from the video input during the second cycle.

The operations and switch closures performed during additional cycles, from the third cycle to cycle n, are similar to operations and switch closures described above. The operations and switch closures performed during odd-numbered cycles and even-numbered cycles mirror the operations and switch closures performed during the first and second cycles, respectively.

The example of the invention described above utilizes 40 processing units (245$_1$ to 245$_{40}$) which require only 40 operational amplifiers (OP1 to OP40). By comparing the invention with the conventional display driver which requires 640 operational amplifiers to drive a display panel 200 having the same size, it can be seen that the object of miniaturizing the display driver is achieved.

Figure 4:
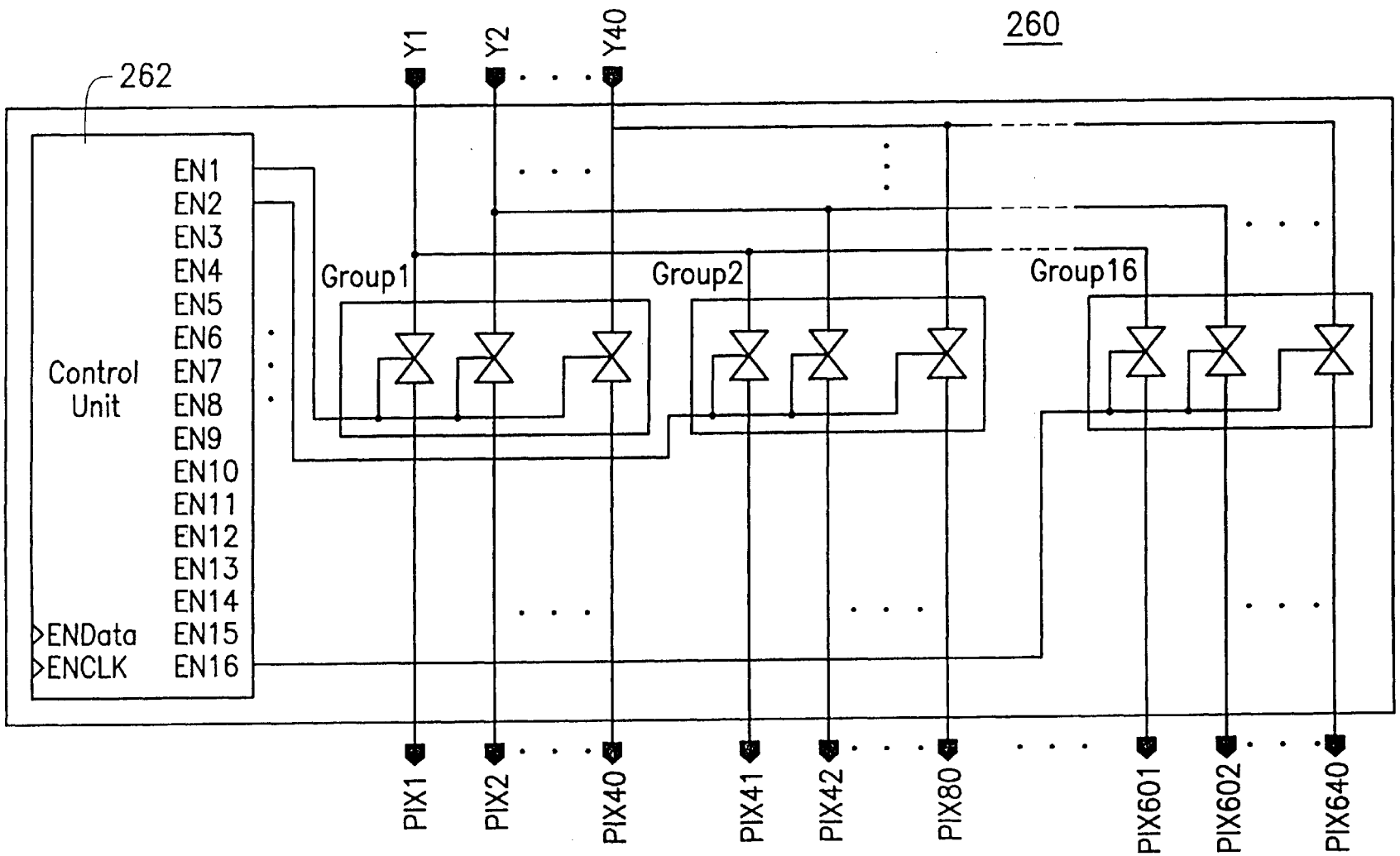
FIG. 4 is a schematic view showing a circuit structure of the group block shown FIG. 2.

Referring to FIG. 4, an exemplary group block 260 includes 16 Groups (Group 1 to Group 16) each of which includes 40 switches. Each Group receives video signal from sample and hold circuit 240 via input lines Y1 to Y40. Furthermore, each Group includes output lines such as output lines PIX1 to PIX40 for Group 1, output lines PIX41 to PIX80 for Group 2 and output lines PIX601 to PIX640 for Group 16.

Control unit 262 controls the switches within each Group in concert to keep the all of the switches within each Group open or closed via group block enable lines EN1 to EN16. For example, when output lines PIX 1 to PIX 40 are ready, control unit 262 turns on all of the Group 1 switches while turning off all of the switches from Group 2 to Group 16 so that the 40 pixel signals from the sample and hold circuit 240 (via input lines Y1 to Y40) can be outputted to the display panel 200 via output lines PIX 1 to PIX 40.

During the next cycle, all switches in Group 2 are turned on while the other Groups' (Group 1 and Groups 3 to 16) switches are turned off. Thus, the outputs from sample and hold circuit 240 are transferred to output lines PIX 41 to PIX 80. This switching process continues for the other Groups (3 to 16) in sequence to transfer pixel signal from sample and hold circuit 240 through successive Groups to the appropriate output lines PIX. In this way, pixel signal from the sample and hold circuit 240 is re-directed to the appropriate lines PIX1 to PIX640 of display panel 200.

By outputting the 16 groups of pixels in order, all of the 640 pixel signals are delivered to the display panel 200. Then, the process of transferring another 640 pixel signals can begin.

Figure 5:
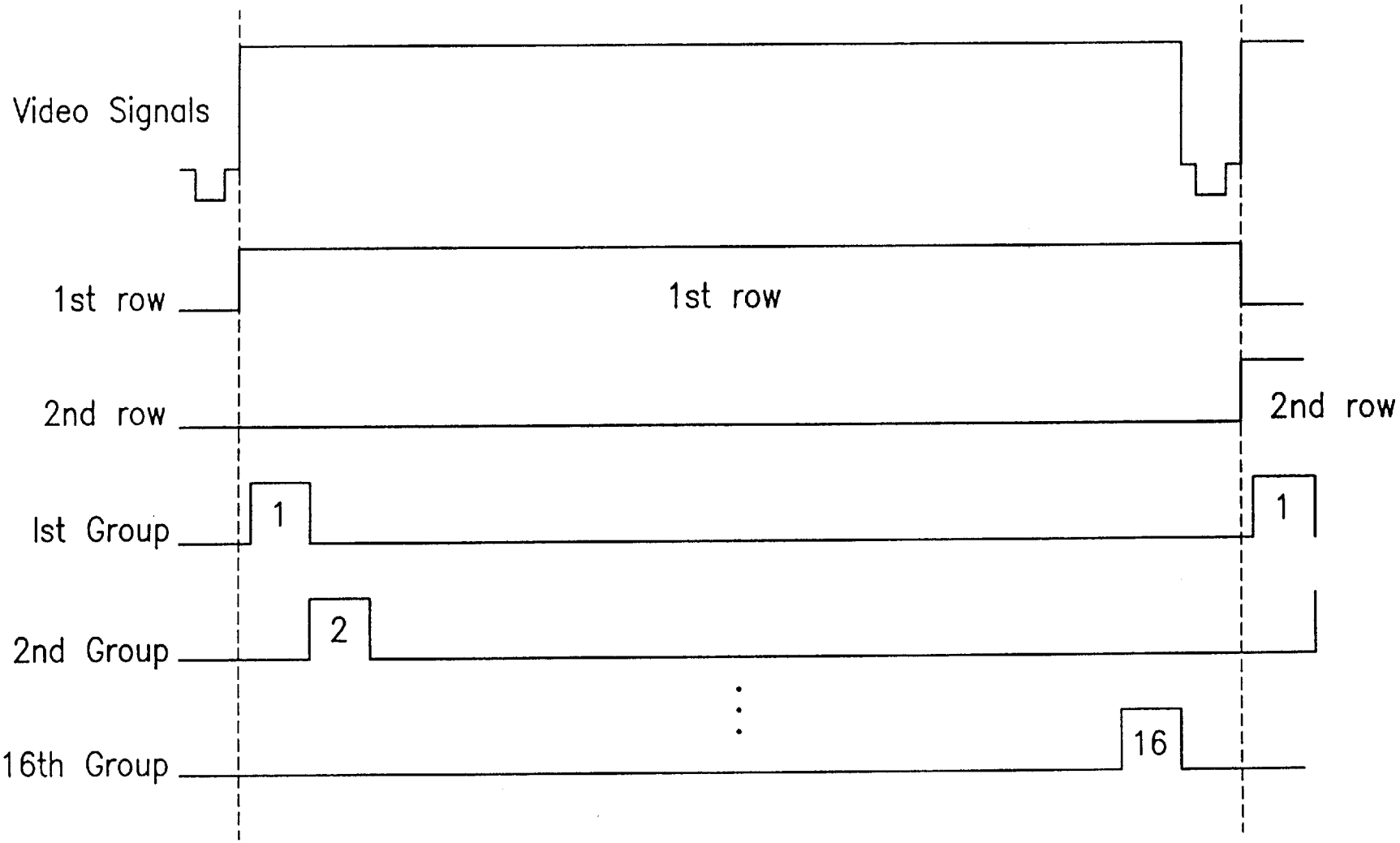
FIG. 5 is a timing diagram showing relative clocks of video signal inputs and group block selects.

FIG. 5 is a timing diagram showing relative clocks generated by the control unit 262 to control the switching operations of the group block 260 via group block enable lines EN1 to EN16. When video signals are fed into the sample and hold circuit 240 of the display driver, the first row of thin-film transistors are selected on the display panel 200.

Thus, as shown in FIG. 5, the state of the first row signal is a high level while the other row signals are at a low level state. The groups (from Group 1 to Group 16) are then sequentially enabled by virtue of the group block enable lines EN1 to EN16 generated by the control unit 262 so as to transfer pixel signal from the sample and hold unit 240 to the 640 output lines PIX 1 to PIX 640.

Meanwhile, the column capacitors and parasitic capacitors of the thin-film transistors are electrically charged.

In the invention, only one Group within group block 260 is active while the other Groups are inactive during specific time periods as shown in FIG. 5. However, all of thin-film transistors in the same row are still enabled, so that the storage capacitors of the pixel can be charged continuously by the column capacitors and the parasitic capacitors of TFT.

The control unit 262 produces the group block enable clocks shown in FIG. 5 for controlling the groups. In the preferred embodiment, the control unit 262 is constructed with a shift register.

However, other electronic devices, such as a decoder or a counter, can also provide the same functions and output control signals as a shift register for the control unit 262. Furthermore, the control unit 262 may also output signals EN1, EN2, etc. shown in FIG. 6 (the group block enable signals) for controlling the ON-OFF states of the switch devices found in the group block 260. The relative timing clocks of these control signals are shown in FIG. 6.

As shown in FIG. 6, during the first 40 pixel sampling periods, the sample and hold circuit 240 samples the first 40 pixels and the control unit 262 disables all groups. During the next 40 pixel sampling periods, the sample and hold circuit 240 performs both the sampling (next 40 pixels) and holding (first 40 pixels) functions. Meanwhile, the first 40 pixel signals sampled during the first 40 pixel sampling periods which are being held during the second 40 pixel sampling periods are delivered to the first group (Group 1). Also during the second 40 pixel sampling periods, the control unit 262 enables the signal EN1 which closes all switches of Group 1 to transfer the first 40 pixels to output lines PIX 1 to PIX 40. This process is repeated for the remainder of the groups. In this way, the groups (Groups 1 to 16) can be successively enabled and disabled in order to deliver video signal to display panel 200.

Figure 7:
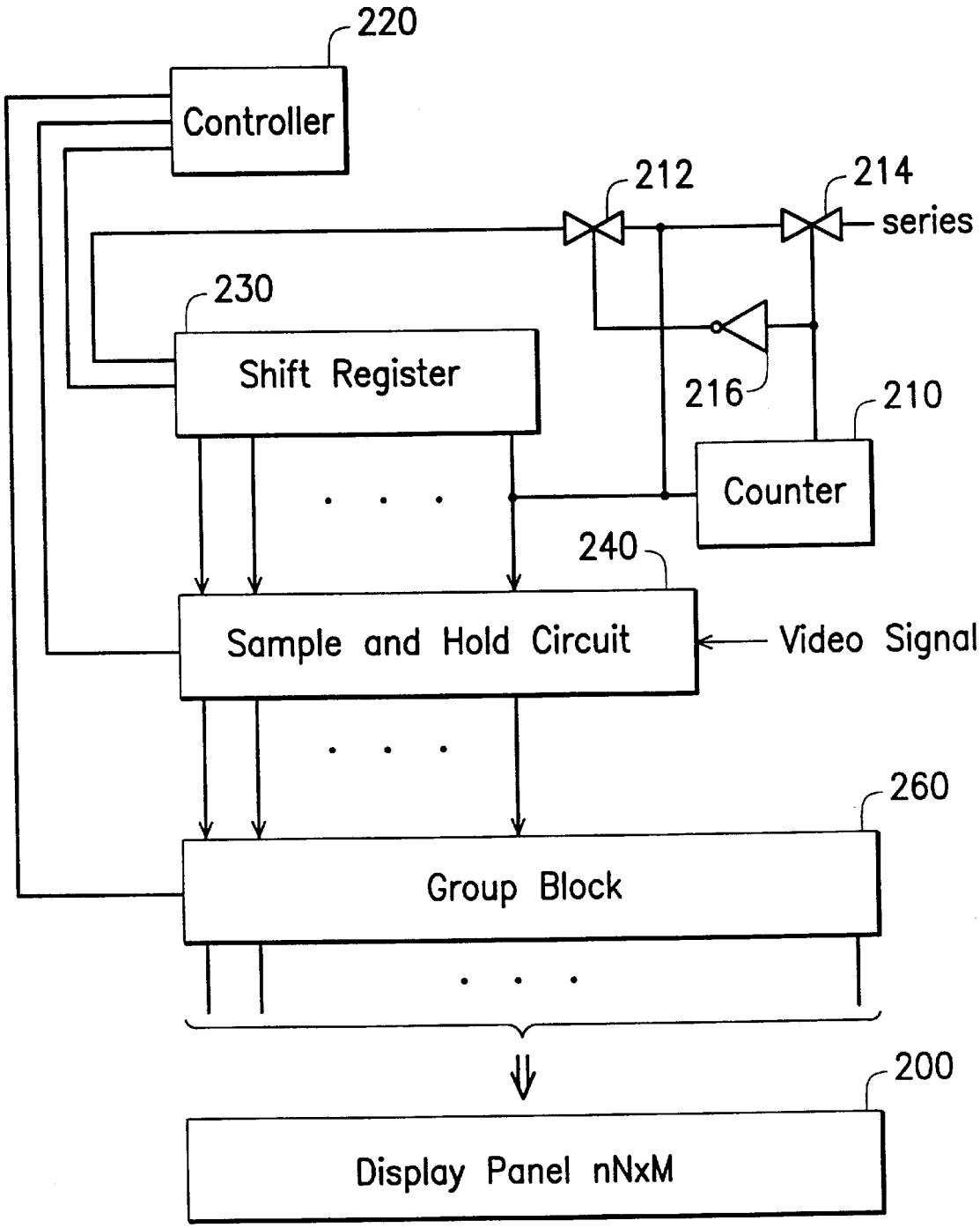
FIG. 7 is a schematic view showing a circuit structure of another embodiment of the invention.

In another preferred embodiment shown in FIG. 7, the additional counter 210 and associated circuitry enhance the abilities of the invention display driver. A serial signal line, "series", is connected to the counter 210. In this preferred embodiment, after 16 groups of signals are delivered, the counter 210 delivers a serial signal via the serial signal line (series) to make a serially connected secondary display driver start operation. The further detailed function description will be explained in the following.

The counter 210 counts up to 16. Before the 16th count is reached, the output of the counter 210 always maintains a low voltage "0" to make a switch 214 open. However, the above-mentioned output "0" will be inverted to a high voltage "1" by an invertor 216 to make a switch 212 closed. In this condition, once the shift register 230 finishes producing the sequence of 20 sampling clocks, the shift register 230 not only sends out a high voltage signal "1" into the counter 210 to make the counter 210 count one time, but also transmits the high voltage signal "1" back to the shift register 230 via the closed switch 212 to make the shift register 230 restart so as to process another 20 pixel signals, but the high voltage can't be outputted to a serial signal line, "series" via the open switch 214 at this point. In the contrary, when the 16th count is reached, the output signal of the counter 210 is transferred to a high voltage "1" from the low voltage "0" to make the switch 214 closed. However, the output signal "1" of the counter 210 will be inverted to a low voltage "0" by an invertor 216 to make the switch 212 open. At this time, the shift register 230 sends out a high voltage "1" (a serial signal) via the closed switch 214 to the serial signal line (series) in order to make a serially connected secondary display driver start operation.

Figure 8:
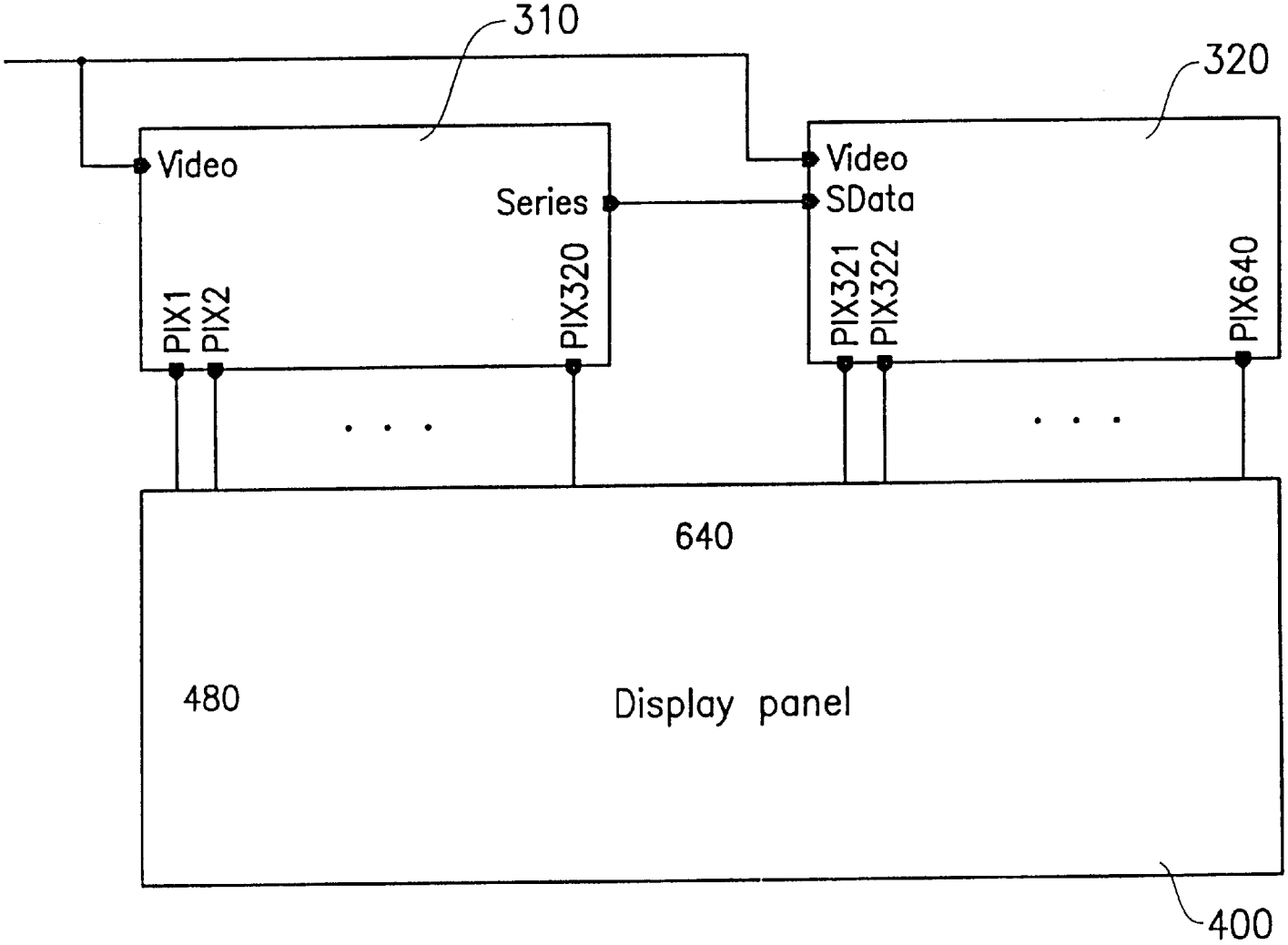
FIG. 8 is a schematic view showing another embodiment of the invention.

Referring to FIG. 8, a schematic view shows serially connected display drivers 310 and 320. Each display driver (310 and 320) has 320 output lines which, taken collectively, drive the 640×480 display panel 400. The display drivers 310 and 320 each process 16 groups of 20 data to provide 320 outputs.

The display driver 310 is connected to secondary display driver 320 by virtue of a serial signal line (series) to ensure that both drivers 310 and 320, taken collectively, provide the complete 640 outputs.

The VGA example of the invention mentioned above achieves 640 outputs by 16 groups of 40 signal arrays or two 16 sets of 20 signal arrays in parallel.

Another combination of the signal array that also meets the spirit of the invention is to decrease the N value in order to reduce the size of the shift register circuit 230 and the sample and hold circuit 240 and to increase the n value in order to reduce circuit space and lower power consumption.

Although the invention has been described in terms of a column driver in which groups of pixels are supplied to columns of a display panel while a row is enabled, it is to be understood that the invention is equally applicable to a row driver in which groups of pixels are supplied to rows of a display panel while enabling a column.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display driver for driving an nNxM or MxnN thin-film transistor liquid-crystal display, comprising:

a first shift register providing N graded sample clocks;

a sample and hold circuit including N processing units controlled by said N graded sample clocks from said first shift register to sample and hold input video signals in groups of N pixels per cycle;

a group block having n groups, each of the n groups including N switches for receiving N pixels per cycle from said sample and hold circuit and including a control line to collectively control the N switches of the group; and a controller controlling said first shift register to provide the N graded sample clocks, controlling said sample and hold circuit to output N video signals per cycle and controlling said group block via the n control lines to redirect the N pixel signals to one of said n groups per cycle to output nN pixel signals to a display panel after n cycles.

2. The display driver as recited in claim 1 wherein said group block includes a control unit successively controlling the N switches in one of the n groups to close per cycle.

3. The display driver as recited in claim 2 wherein said control unit includes a second shift register.

4. The display driver as claimed in claim 2 wherein said control unit includes a decoder.

5. The display driver as claimed in claim 2 wherein said control unit includes a counter.

6. The display driver as recited in claim 1, further comprising a counter connected to said first shift register.

7. The display driver as recited in claim 6 wherein said counter is an n-counter.

8. The display driver as recited in claim 6 wherein said counter includes a serial signal line for triggering a serially connected secondary display driver.

9. The display driver as recited in claim 1 wherein said sample and hold circuit includes N processing units each of which includes two pairs of switches, a pair of capacitors, and an operation amplifier.

10. The display driver as recited in claim 1 wherein n is equal to 16, N is equal to 20, and said group block provides 320 outputs.

11. The display driver as recited in claim 1 wherein n is equal to 16, N is equal to 40, and said group block provides 640 outputs.

12. The display driver as recited in claim 1 wherein said controller controls relative clocks among said first shift register, said sample and hold circuit, and said group block.

* * * * *